United States Patent [19]

Martin

[11] Patent Number: 5,025,774

[45] Date of Patent: Jun. 25, 1991

[54] COMPETITION BOW WITH IMPROVED VIBRATIONAL BEHAVIOR

[76] Inventor: Jacques Martin, 1, rue Fort Louis, 67000 Strasbourg, France

[21] Appl. No.: 384,368

[22] Filed: Jul. 25, 1989

[30] Foreign Application Priority Data

Jul. 25, 1988 [FR] France ..... 88 10170

[51] Int. Cl.[5] ..... F41B 5/00

[52] U.S. Cl. ..... 124/89; 124/88; 124/23.1; 124/41.1

[58] Field of Search ..... 124/89, 88, 23 R, 41 A, 124/86

[56] References Cited

U.S. PATENT DOCUMENTS

| | | | |
|---|---|---|---|
| 4,119,078 | 10/1978 | Wilson et al. | 124/41 A |
| 4,170,980 | 10/1979 | Killian | 124/41 A |
| 4,175,536 | 11/1979 | Carella | 124/88 X |
| 4,207,859 | 6/1980 | Scholten | 124/24 R |
| 4,338,909 | 7/1982 | Plummer | 124/23 R X |
| 4,542,731 | 9/1985 | Quartino | 124/41 A |
| 4,574,766 | 3/1986 | Izuta | 124/23 R |
| 4,592,332 | 6/1986 | Topping | 124/41 A |
| 4,660,538 | 4/1987 | Burgard | 124/89 |
| 4,672,943 | 6/1987 | Bozek | 124/23 R |
| 4,729,256 | 3/1988 | Kelson | 74/551.9 |
| 4,867,129 | 9/1989 | Scherz | 124/41 A |
| 4,878,397 | 11/1989 | Lennon | 74/51.9 |
| 4,881,515 | 11/1989 | Simo | 124/24 R |

FOREIGN PATENT DOCUMENTS

| | | |
|---|---|---|
| 2346157 | 3/1975 | Fed. Rep. of Germany . |
| 2559888 | 8/1985 | France . |
| 0114300 | 10/1978 | Japan . |

*Primary Examiner*—Peter M. Cuomo
*Assistant Examiner*—Carol I. Bordas
*Attorney, Agent, or Firm*—Schwartz & Weinrieb

[57] ABSTRACT

Collapsible competition bow with improved vibrational behavior includes a longitudinally extending bow body having substantially rectangular parallelepiped sockets defined upon opposite ends thereof. Two flexible branches are respectively disconnectably mounted within the end sockets of the bow body and are secured therein by means of an immobilizing cam system. A spreader system is also provided within the blow body wherein the spreader system is adjustable both horizontally, vertically, and axially as may be desired.

15 Claims, 3 Drawing Sheets

COMPETITION BOW WITH IMPROVED VIBRATIONAL BEHAVIOR

FIELD OF THE INVENTION The present invention relates generally to archery bows, and more particularly to a collapsible competition bow with improved vibrational behavior.

BACKGROUND OF THE INVENTION

Archery has undergone great development in recent years, and the high-performance equipment designed to satisfy the required expectations has been significantly improved.

Thus, for 10 years all bows have had the same structure and the same general characteristics associated with the proper functional conditions of competitive archery. For practical reasons, they are most often collapsible, made up of a bow body and two flexible end branches detachably fastened to the body of the bow, intended for stretching the bowstring.

The branches constitute the flexible parts of the bow that store the potential energy when the bowstring is placed under tension. In collapsible bows they have a fastening shoulder at one end that permits them to be mounted on the body of the bow. At the other end these branches have a tip and a nock for placing the bowstring.

The body of the bow, which is its central part, has three principal elements, specifically:

the window where the accessories for aiming and supporting the arrow are fastened, particularly the spreader system that permits separating the arrow more or less from the body of the bow;

the grip for gripping and holding the bow;

the mounts for fastening the branches most often being done by means of a screw system.

Added to these principal elements are a number of additional elements, including stabilizers composed of a stock of variable length on which may slide a poise of variable weight, with the stock being screwed to the body of the bow through a connection damper. The function of these stabilizers is to balance the bow and to absorb some of the vibrations.

The vibrational behavior of the bow proves to be complex and the source of problems that may become major. Actually, the vibrations generated by shooting are propagated in the various elements of the bow and are transmitted harmfully to the user's wrist. They affect the precision of shooting and divert the bow after shooting, sometimes in an uncontrollable manner.

The stabilizers presently used do not constitute a satisfactory solution because of their low efficiency in neutralizing vibrations.

Another difficulty consists of the nature and reduced capabilities of the spreader system intended for aligning the position of the arrow before shooting. Actually, the known spreader systems generally permit only a single adjustment of the position of the arrow, which can be only separated more or less from the body of the bow, but whose position cannot be changed in height.

OBJECT OF THE INVENTION

The object of this invention is to correct all of the aforenoted drawbacks by providing a collapsible bow for competition with improved vibrational behavior relative to that of known bows, and which also has a spreader system that permits better alignment of the arrow.

SUMMARY OF THE INVENTION

The foregoing and other objectives of this invention are achieved through the provision of a collapsible competition bow characterized by the fact that it has in combination, on the one hand, a bow body obtained by molding that has a principal part whose general axis is rectilinear, extended at each end by a connecting plate reinforced by ribs ending at the extremities of approximately parallelepiped shape inclined relative to the principal part, and having no perforation, and on the other hand, two semirigid sleeves each forced onto one of the two ends of the body of the bow and having the shape of a hollow parallelepiped, with the bow also having two flexible insertable branches whose ends assume a parallelepiped shape matching that of the ends of the body so that they can be imbedded in the mount defined by the sleeves and the ends of the aforesaid body, with the bow also having a spreader system mounted in a bore made in the window of the body of the bow, that permits adjusting the position of the arrow both horizontally and vertically. The body of the bow pursuant to the invention can be obtained by molding a metal alloy of the type of those used in aeronautics.

Its parallelepiped ends connected to the body of the bow by reinforcing ribs provide the advantage of a mechanical connection with low torsion with a large mass, which promotes the solidity and dynamic and static stability of the bow while at the same time damping the vibrations, making unnecessary the presence of frontal stabilizers located at the two ends of the body of the bow.

Holding each branch by imbedding it in a sleeve that does not make use of a technique utilizing transverse fasteners, for example screwing, likewise promotes the damping of vibrations in the same way as the absence of frontal stabilizers, with the perforations necessitated by the screw fastening systems for the branches and by the frontal stabilizers constituting vibration sinks and producing concentrations of stresses that weaken the mechanical strength of the bow while generating low-frequency vibrations.

In accordance with the invention, the semirigid receiving sleeves are made of carbon fibers, and more precisely of a material obtained by weaving carbon threads. They have a thickness of several millimeters and a length matching that of the parallelepiped ends of the body of the bow. The use of carbon fibers permits making sleeves of lightweight nature and at the same time with exceptional mechanical strength, while also contributing to the damping of vibrations.

The ends of the body of the bow, as stated above, are forced into the sleeves, which can be fastened to it by cementing. The corresponding flexible branch is then inserted into the sleeve where they can be positioned isostatically because of six suitably positioned points of a wear-resistant material, such as that known by the name Teflon.

The nature of the material of which the sleeve is made, i.e., carbon fibers, gives it strongly damping properties with respect to high-frequency vibrations.

The static and dynamic balancing of the body of the bow, because of the massive extremities, enables the transformation of low-frequency vibrations of the characteristic modes of its elements into high-frequency vibrations, which are strongly attenuated by the semi-rigid material of which the sleeves are made.

Because of its original design, the body of the bow pursuant to the invention shows vibrational behavior very clearly superior to that of existing bow bodies, specifically making unnecessary the presence of frontal stabilizers positioned at the two ends of the bow body. This also results in an appreciable gain relative to the weight of the bow and its cost.

The damping of the vibrations of the body of the bow can also be improved by placing an orthopedic overgrip made of a material of the expanded foam type on its grip.

Such an overgrip can be made by cold injection of a foam of a synthetic resin into a formable envelope fastened by cementing to the grip of the bow.

The damping can be improved further by a wedge-holding device producing pressure contact against the large side of the insertable end of each flexible branch.

BRIEF DESCRIPTION OF THE DRAWINGS

The invention will be better understood by reading the following detailed description of a bow body pursuant to the invention shown in the attached drawings, with the understanding that this description does not limit the invention in any way, wherein like reference characters designate like or corresponding parts throughout the several views, and wherein.

DETAILED DESCRIPTION OF THE PREFERRED EMBODIMENT

Figure 1:
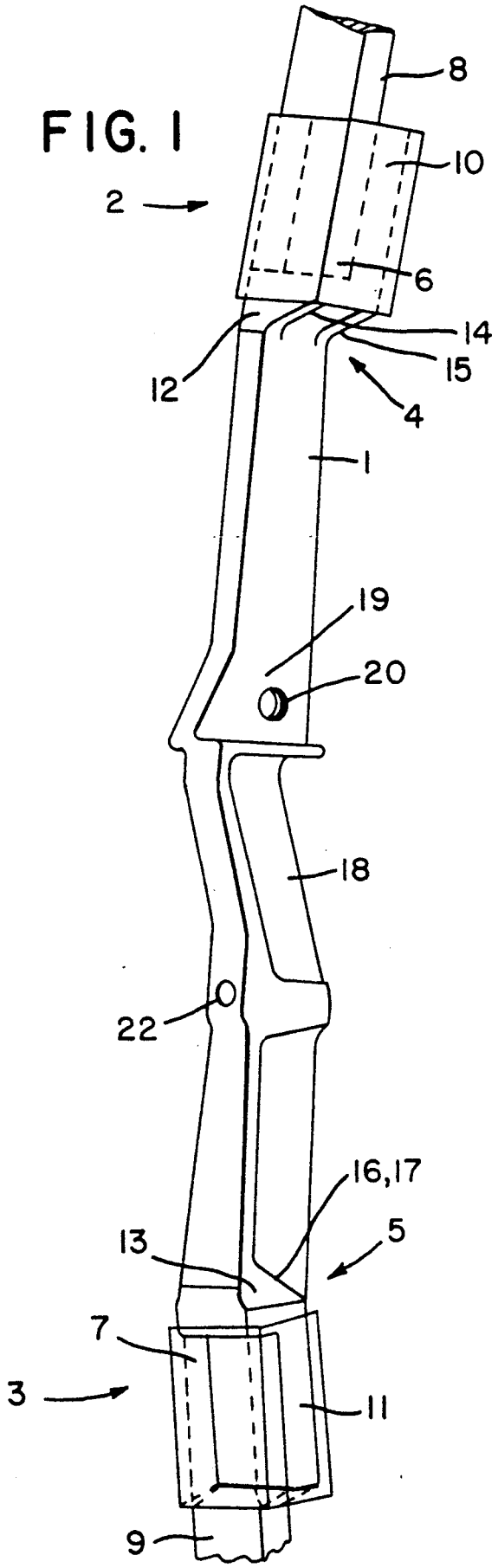
FIG. 1 is a perspective view of three-fourths of the body of a bow pursuant to the invention.

In FIG. 1, it is seen that the body of the bow comprises a principal part 1 whose general longitudinal axis direction is rectilinear, extended by two ends 2 and 3 of parallelepiped shape inclined relative to the general direction of the principal part 1, and each having a shoulder 4 and 5, on each of which can rest the shoulder of one of the ends 6 and 7 of a flexible bow branch 8 and 9 that can be disconnected from the principal part 1.

An insertion sleeve 10 or 11, likewise of parallelepiped shape, is fitted on each of the two ends 2 or 3 of the body of the bow. It is forced in, leaving a free space in the interior volume of each sleeve, forming a mount of the shape and dimensions corresponding to those of each end 6 or 7 of the corresponding flexible branch 8 or 9.

The ends 2 and 3 of the body of the bow are connected to the central part by a curve of the material 12 and 13 supplemented on the rear face by two reinforcing ribs 14, 15 and 16, 17 that improve the rigidity and stability of the bow. In the principal part 1 of the body of the bow is shaped a grip 18 surmounted by a window 19 in which is made a cylindrical bore 20 for a spreader system 21.

Another bore 22 located just below the grip 18 serves for the placement of a central stabilizer, not shown.

Figure 2:
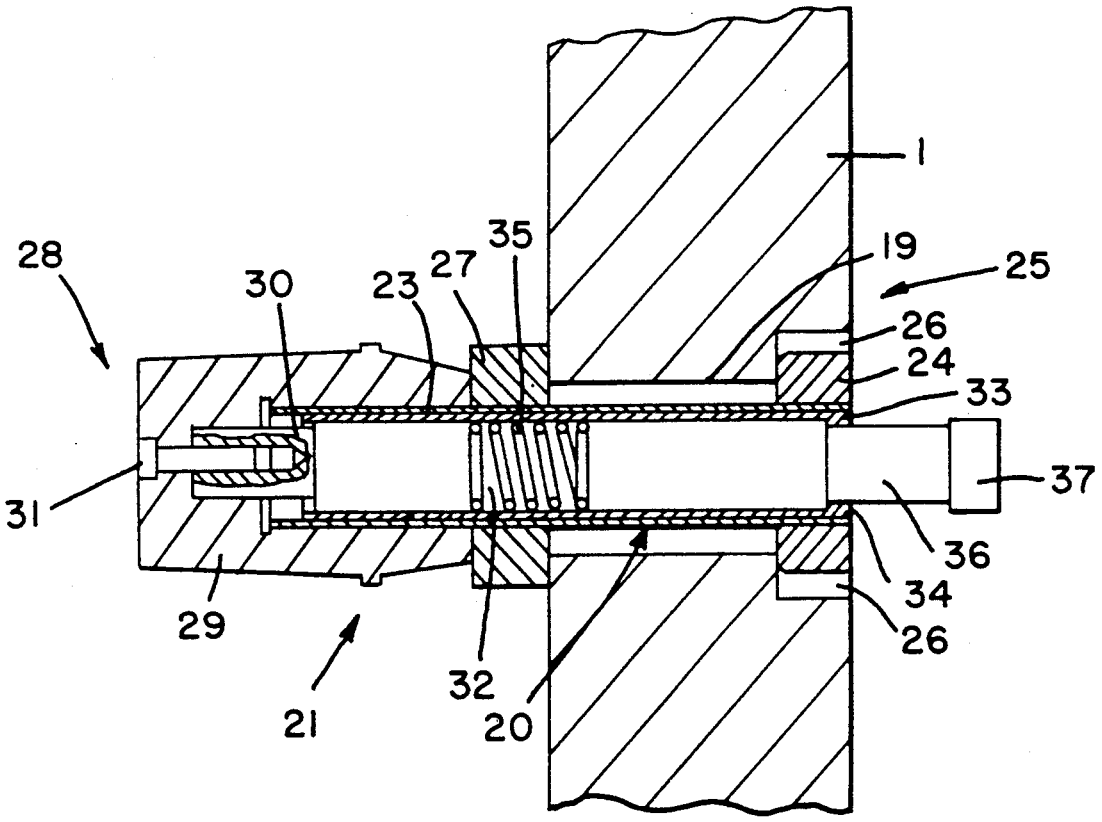
FIG. 2 is a longitudinal sectional view of the spreader system that is mounted in the bore shown in FIG. 1.
Figure 3:
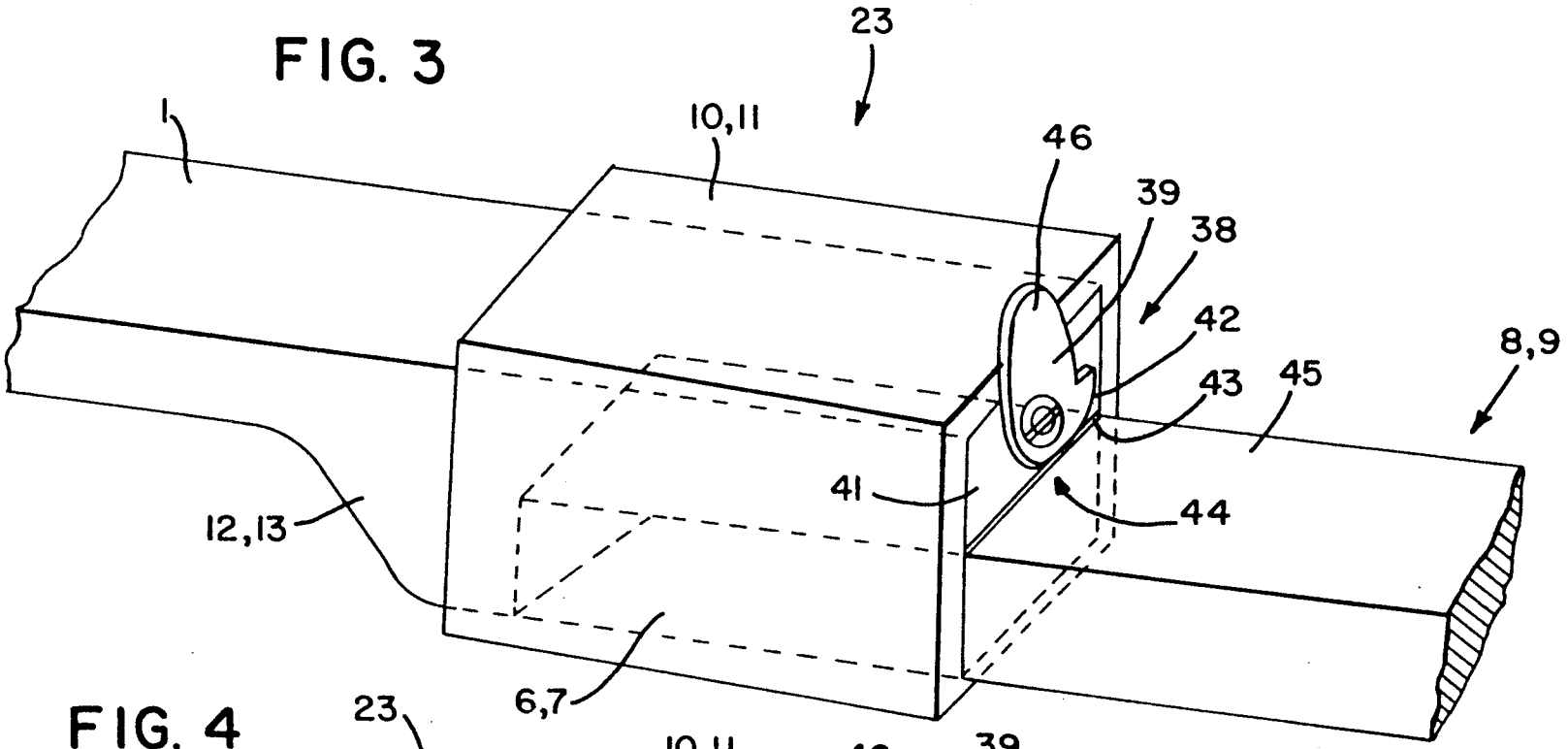
FIG. 3 is a schematic perspective view showing an example of an immobilizing device and its placement at the end of the body of the bow.
Figure 4:
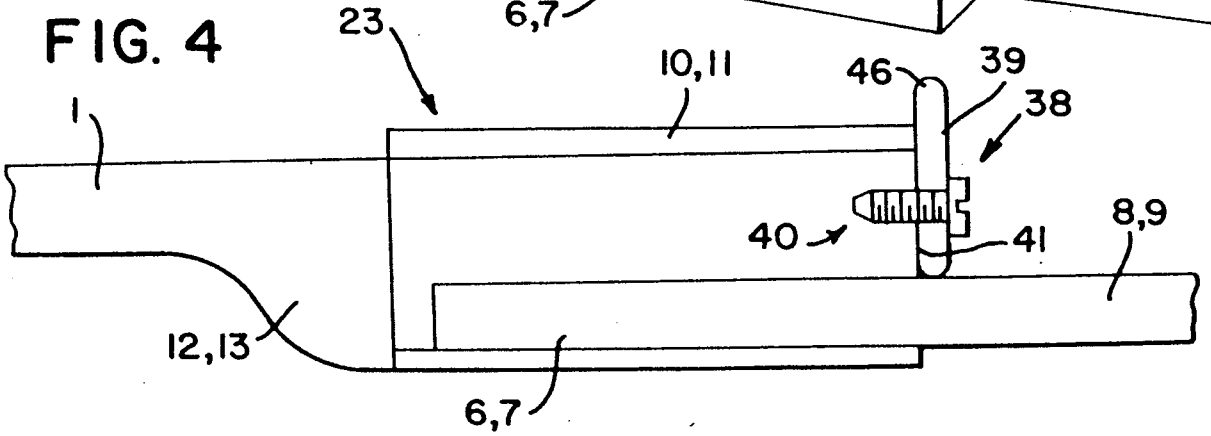
FIG. 4 is a longitudinal sectional view of the end of the body of the bow at the point of insertion of the branches.

In FIG. 2 is shown the spreader system 21 composed of a hollow screw 23 mounted in the bore 20 formed in the body of the bow. This screw 23 is made integral with the body of the bow, on the one hand by means of a nut 24 mounted at one end of the screw 23 and resting against one of the sides 25 of the bow body in a cylindrical recess 26 machined at one end of the bore 20, and on the other hand by a locknut 27 associated with an adjusting head 28 mounted at the other end of the screw 23 and resting against the other face of the bow body.

The adjusting head 28 is composed of a nut 29 mounted on the screw 23 and resting against the locknut 27, and of a cylindrical part 30 made integral with the nut 29 by means of a screw 31 and housed in a cavity 32 made in the screw 23, and terminated by a bottom 33 and a bore 34. This cylindrical part 30 serves to compress a spring 35 mounted in the cavity 32 between the cylindrical part 30 and a pushbutton 36 with a sleeve that rests against the bottom 33 of the screw 23.

Screwing the nut 29 into the screw 23 causes the displacement of the part 30, which compresses the spring 35, and conversely, unscrewing the nut 29 causes the loosening of the spring 35. The pushbutton 36 is made up of two cylinders with different diameters. The narrower cylinder passes through the bore 34 and its fitted head 37 supports the arrow.

Unscrewing the nut 24, the locknut 27, and the adjusting head 28, it is possible to shift the assembly in the bore 20 to modify the position of the pushbutton 36 either vertically or laterally, as well as its separation from the side of the bow body. Once the adjustment is made, retightening the assembly fixes the pushbutton 36 at the chosen position.

In order to improve further the vibrational behavior of the bow and to eliminate the wear of the imbedded ends of the flexible branches in the end sleeves, this invention provides for a wedge-holding device.

For example, this is a device 38 for immobilization by wedge-holding, using a cam 39 assembled integrally with a shaft 40 that can rotate over an angular deviation amplitude sufficient for obtaining proper locking by pressure.

This device is mounted in a conventional way on the two transverse edges 41 of the two ends 2 and 3 of the bow body, each covered by a receiving sleeve 10 or 11 of one end 6 or 7 to hold a flexible bow branch 8 or 9. The shaft 40 is carried by a receptacle part, socket, or other part 41 integral with the body of the bow, or is held fast in a tapped bore. Any other mounting is possible.

Thus, the cam pivots either around the shaft 40 or with this shaft.

It is operated manually to be able easily to be disengaged by pivoting at each insertion or detachment of the flexible branches.

The part 39 that serves as a cam has a curvilinear profile 42 slightly curved over a portion of its contour 43 to bear on an area 44 of greater area on one of the large sides 45 opposite the imbedded end of each flexible branch 8 or 9.

This cam 39 is made of semihard synthetic material, for example nylon, polyamide, or polyester, so as to benefit from the slight elastic compression of the material against the harder face of the flexible branch of the bow.

Elimination of wear is thus accomplished, along with immobilizing pressure sufficient for the end of the branch to grip the body with the sleeve properly, and thus to neutralize the parasitic vibrations that may remain. In accordance with another embodiment, the cam mounted to pivot relative to the body of the bow is operated by using a key or other tool that is held in its head to be able to pivot either the cam or its shaft 40 which may be made integral with the cam.

The body of the cam preferably has a projection 46 located opposite its area of contact with the corresponding flexible branch, to be able to operate it manually more easily.

It can also have elastic return to the clamping position.

The immobilizing device pursuant to the invention, because of the pressure contact, provides for mechanical locking for holding the branches mechanically, and provides supplementary damping of the vibrations originating from shooting.

It also assures elimination of the play due to mechanical wear of the extremity of the branch, which is successively imbedded and then relieved at each shooting sequence.

As stated above, the preceding description does not limit this invention in any way. Thus, the body of the bow described can undergo a number of modifications without departing from the scope of the invention. In particular, its extremities can assume a shape other than a parallelepiped shape, for example a truncated pyramid, and the fastening sleeves can have the corresponding matching shape.

I claim:

1. An archery bow, comprising:

a longitudinally extending bow body having opposite end portions;

a pair of hollow sleeves respectively disposed upon said opposite end portions of said bow body;

a pair of bow branches having a configuration substantially corresponding to that of said pair of hollow sleeves such that said pair of bow branches can be accommodated within said pair of hollow sleeves;

spreader means mounted upon said bow body for permitting both horizontal and vertical adjustment of an arrow with respect to said bow body; and cam type immobilizing means rotatably mounted upon said opposite end portions of said bow body so as to be movable between a first position at which said cam type immobilizing means engages said pair of bow branches disposed within said pair of hollow sleeves so as to force said pair of bow branches into contact with interior wall surfaces of said pair of hollow sleeves and thereby fix said pair of bow branches within said pair of hollow sleeves and upon said opposite end portions of said bow body, and a second position at which said cam type immobilizing means disengages said pair of bow branches disposed within said pair of hollow sleeves so as to permit said pair of bow branches to be removed from said pair of hollow sleeves.

2. Bow pursuant to claim 1, characterized by the fact that the hollow sleeves are made of carbon fibers.

3. Bow pursuant to claim 2, characterized by the fact that the hollow sleeves are made of a material obtained by weaving carbon threads.

4. Bow pursuant to claim 1, characterized by the fact that said bow body includes a grip which is covered by an orthopedic overgrip made of expanded foam.

5. Bow pursuant to claim 4, characterized by the fact that said orthopedic overgrip is made by cold injection of a foam of a synthetic resin into a formable envelope fastened to the grip of the bow by cementing.

6. Bow pursuant to claim 1, characterized by the fact that said bow body is obtained by molding a metal alloy of an aeronautical type.

7. A bow as set forth in claim 1, wherein said spreader means comprises:

a bore defined within said bow body;

a hollow screw disposed within said bore of said bow body;

a first nut threadedly engaged upon a first end of said hollow screw for engaging a first side of said bow body;

a locknut threadedly engaged upon a second end of said hollow screw for engaging a second side of said bow body;

an adjusting head nut adjustably rotatable upon said second end of said hollow screw;

cylinder means disposed within said second end of said hollow screw and operatively connected to said adjusting head nut;

a pushbutton arrow rest projecting outwardly from said first end of said hollow screw; and a spring disposed within said hollow screw and interposed between said cylinder means and said arrow rest for biasing said arrow rest outwardly from said hollow screw and away from said first side of said bow body in response to rotatable adjustment of said adjusting head nut and said cylinder means operatively connected thereto.

8. A bow as set forth in claim 1, wherein:

said end portions of said bow body comprise solid parallelepiped members;

said hollow sleeves comprise hollow parallelepiped members mounted upon said solid parallelepiped end portions of said bow body; and said bow branches comprise end portions comprising solid parallelepiped members for insertion within said hollow parallelepiped sleeves.

9. A bow as set forth in claim 1, wherein:

said cam type immobilizing means comprises a rotary cam having a curvilinear profile at one end thereof for engaging said bow branch, and a manually operable projection at a substantially opposite end thereof for manually rotating said rotary cam between said first and second engaged and disengaged positions, respectively.

10. A bow as set forth in claim 9, wherein:

said rotary cam is fabricated from nylon.

11. A bow as set forth in claim 9, wherein:

said rotary cam is fabricated from a polyamide.

12. A bow as set forth in claim 9, wherein:

said rotary cam is fabricated from a polyester.

13. An archery bow, comprising:

a longitudinally extending bow body having opposite end portions;

a pair of hollow sleeves respectively disposed upon said opposite end portions of said bow body;

a pair of bow branches having a configuration substantially corresponding to that of said pair of hollow sleeves such that said pair of bow branches can be accommodated within said pair of hollow sleeves;

spreader means mounted upon said bow body for supporting an arrow with respect to said bow body; and cam type immobilizing means rotatably mounted upon said opposite end portions of said bow body so as to be movable between a first position at which said cam type immobilizing means engages said pair of bow branches disposed within said pair of hollow sleeves so as to force said pair of bow branches into contact with interior wall surfaces of said pair of hollow sleeves and thereby fix said pair of bow branches within said pair of hollow sleeves and upon said opposite end portions of said bow body, and a second position at which said cam type immobilizing means disengages said pair of bow branches disposed within said pair of hollow sleeves so as to permit said pair of bow branches to be removed from said pair of hollow sleeves.

14. A bow as set forth in claim 13, wherein:

said end portions of said bow body comprise solid parallelepiped members;

said hollow sleeves comprise hollow parallelepiped members mounted upon said solid parallelepiped end portions of said bow body; and said bow branches comprise end portions comprising solid parallelepiped members for insertion within said hollow parallelepiped sleeves.

15. A bow as set forth in claim 13, wherein:

said cam type immobilizing means comprises a rotary cam having a curvilinear profile at one end thereof for engaging said bow branch, and a manually operable projection at a substantially opposite end thereof for manually rotating said rotary cam between said first and second engaged and disengaged positions, respectively.

* * * * *